United States Patent [19]

Harper et al.

[11] Patent Number: 4,765,056

[45] Date of Patent: Aug. 23, 1988

[54] METHOD OF MANUFACTURE OF HELICAL WAVEGUIDE STRUCTURE FOR TRAVELING WAVE TUBES

[75] Inventors: Robert Harper, Concord; Joseph L. Rousseau, Billerica, both of Mass.

[73] Assignee: Raytheon Company, Lexington, Mass.

[21] Appl. No.: 847,999

[22] Filed: Apr. 3, 1986

[51] Int. Cl.[4] ..... H01J 9/00

[52] U.S. Cl. ..... 29/600; 315/3.5

[58] Field of Search ..... 315/3.5; 29/558, 600

[56] References Cited

U.S. PATENT DOCUMENTS

| | | | |
|---|---|---|---|
| 3,376,463 | 4/1968 | Feinstein | 29/600 |
| 4,185,225 | 1/1980 | Doehler et al. | 315/3.5 |
| 4,229,676 | 10/1980 | Manoly | 29/600 X |
| 4,268,778 | 5/1981 | Friz | 315/3.5 |
| 4,347,419 | 8/1982 | Jasper, Jr. | 29/600 X |

*Primary Examiner*—Howard N. Goldberg

*Assistant Examiner*—Taylor J. Ross

*Attorney, Agent, or Firm*—Martin M. Santa; Richard M. Sharkansky

[57] ABSTRACT

A waveguide helical slow-wave structure is formed of a solid rod of copper machined with a deep, narrow helical groove. A copper sleeve is brazed to the periphery of the resulting helical thread to form a helically spiraling pathway about a solid axially centered and axially extending center portion. The center portion is then partially eroded away to form a slow wave structure having a helical radially-extending portion with an inner helical axially-extending ridge to provide a helical axially-centered gap between adjacent ridges. The slow wave structure contains the microwave energy which follows the spiral path of the structure and produces RF voltage across the gap of adjacent portions of the ridges to thereby form a gapped-wall surrounding an axially-extending hole for gap electric field interaction with the axial electron beam of a traveling wave tube of which the slow wave structure is a part.

8 Claims, 3 Drawing Sheets

METHOD OF MANUFACTURE OF HELICAL WAVEGUIDE STRUCTURE FOR TRAVELING WAVE TUBES

BACKGROUND OF THE INVENTION

This invention relates to traveling wave tubes and more particularly to the slow wave structure of a traveling wave tube which is required in order to couple the incoming microwave energy at several tens of gigahertz frequency to the electron beam of the traveling wave tube in order to thereby amplify the incoming microwave energy and to remove the amplified microwave energy at the other end of the slow wave structure.

The desirability of a helical waveguide for providing a slow wave structure has been recognized for many years. The structure of the helical waveguide of this invention consists of half of a rectangular center ridge waveguide wound around in a spiral with a hole down the center for an electron beam. The fundamental mode of propagation of the waveguide is effectively slowed relative to the axial movement of electrons by causing the propagating RF energy to follow the spiral pathway.

Although conceptually simple in design, the problem is how to make such a helical waveguide structure, especially for high frequency tubes where the waveguide dimensions are measured from hundredths of inches.

SUMMARY OF THE INVENTION

A waveguide helical slow-wave structure is formed of a solid rod of copper machined with a deep, narrow helical groove. A copper sleeve is brazed to the periphery of the resulting helical thread to form a helically spiraling pathway about a solid axially centered and axially extending center portion. The center portion is then partially eroded away to form a slow wave structure having a helical radially-extending portion with an inner helical axially-extending ridge to provide a helical axially-centered gap between adjacent ridges. The slow wave structure contains the microwave energy which follows the spiral path of the structure and produces RF voltage across the gap of adjacent portions of the ridges to thereby form a gapped-wall surrounding an axially-extending hole for gap electric field interaction with the axial electron beam of a traveling wave tube of which the slow wave structure is a part.

BRIEF DESCRIPTION OF THE DRAWINGS

The aforementioned aspects and other features of the present invention will be apparent from the following description taken in conjunction with the accompanying drawings wherein.

DESCRIPTION OF THE PREFERRED EMBODIMENT

Figure 1:
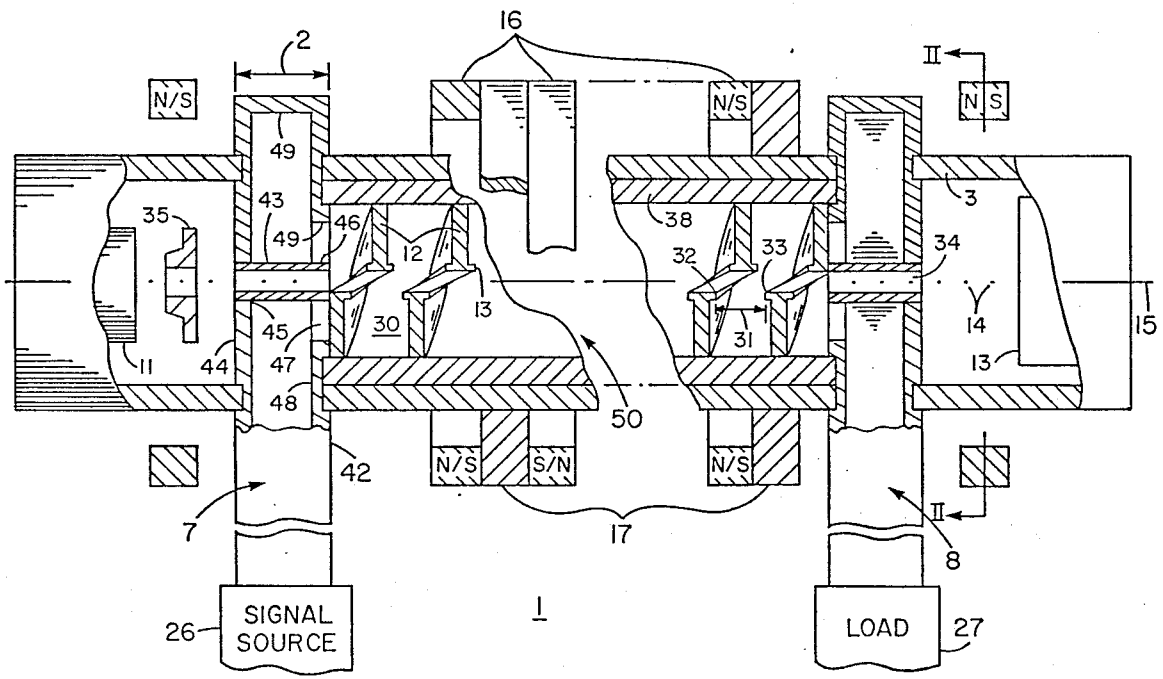
FIG. 1 is a partial sectional view taken along the central axis of a traveling wave tube showing the helical waveguide slow wave structure of the invention.

Referring to FIG. 1, there is shown a longitudinal sectional view of traveling wave tube 1 comprising a cathode 11, which is shown diagrammatically and is understood to include the assembly of the focussing electrodes, an anode 35, and a collector 13 which is also shown diagrammatically, the collector 13 being understood to include a heat sink. The cathode 11 and the anode 12 provide an electron beam 14 along an axis 15 of the slow wave structure shown as the helical waveguide 50. The beam 14 is focussed in a conventional manner by a set of permanent magnets 16 having a toroidal form and interleaved with discs 17 which are shown in simplified form in FIG. 1, the rings 17 being of high-permeability material, such as iron, for shaping the magnetic field at the electron beam 14. Coupling of electromagnetic energy at each end of the slow wave structure 50 is accomplished by input and output couplers 7, 8, respectively. Each coupler 7, 8 consists of a waveguide 42 which extends transversely through tube 1 and its axis 15 and with its narrowest dimension 2 parallel to axis 15. Waveguide 42 contains a cylindrical sleeve 43 which is in axial alignment with axis 15 of slow wave structure 50. Sleeve 43 has the same inside diameter as the ridge 13 of helical waveguide slow wave structure 50. Sleeve 43 is supported at one end 45 by wall 44 of waveguide 42, and at its other end 46 there is a circular aperture 47 in wall 48 bounded by the circular perimeter 49 of a cut-out of wall 48. Waveguide 42 is terminated by a short-circuiting end wall 49 which is longitudinally displaced from the sleeve 43. The displacement (usually one-eighth to one-quarter wavelength), and the diameter and length of sleeve 43 determine the impedance and coupling of waveguide 42 to slow wave structure 50.

Figure 2:
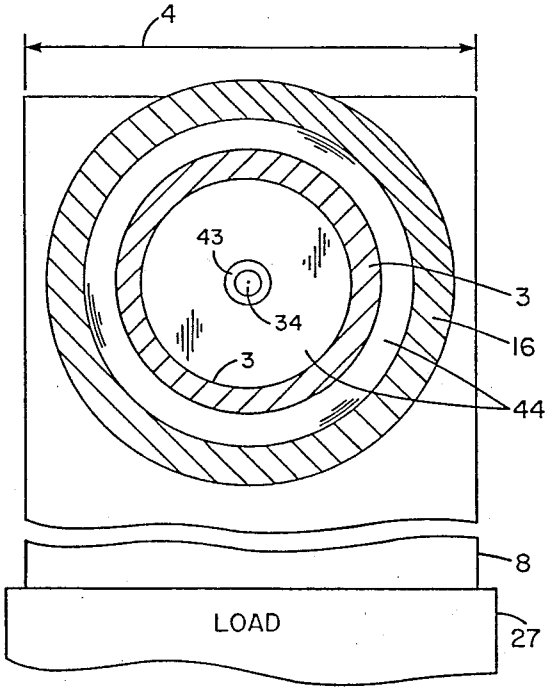
FIG. 2 is an end view taken along section line II—II of FIG. 1.

FIG. 2 is an sectional end view taken along section line II—II of FIG. 1 showing the width 4 of the waveguide 42 in relationship to the tube 1 wall 3 and toroidal magnets and iron discs 16, 17, respectively.

Sleeve 43 couples electromagnetic energy from the signal source 26 to the slow wave structure 50 where the electromagnetic energy across gap 31 interacts with the electron beam 14 to be amplified and to advance along the slow wave structure 50 to the output coupler 17 where the energy is coupled to the load 27. The energy travels helically down the traveling wave tube 1 in the spiral space 30 which exists between spiraling radially directed screwthreads 12. The spiral path taken by the electromagnetic energy in passing down the slow wave structure 50 from the input end to the output end of the traveling wave tube reduces the effective axially-directed velocity of the voltage generated in the gap 31 between the proximate edges 32, 33 of the spiraling ridge 13 to substantially the same velocity as that of the electrons of the electron beam 14 as they travel axially down the traveling wave tube. As a result of approximate equality of the axial velocity of the electric field in gap 31 between the adjacent ridges 13 and the electron beam 14 velocity, there is coupling of the input electromagnetic energy to the electron beam in such a way as to cause amplification of the electromagnetic energy as the beam travels down the axis 15 of the tube 10 in a manner well known to those skilled in the traveling wave tube art.

Fabrication of a waveguide slow wave structure 50, such as that shown in FIG. 1, would be difficult even for those instances where the traveling wave tube operates at relatively low frequencies thereby allowing the dimensions of the slow wave structure 50 to be relatively large. The construction of a slow wave structure 50 for use in traveling wave tubes which operate at very high frequencies, i.e., above 20–30 GHz as in this invention, requires innovative fabrication techniques. At these frequencies, a slow wave structure 50 has as typical dimensions: a screwthread 12 diameter of approximately one-quarter of an inch, an overall length of approximately one inch, a pitch of approximately one-tenth inch, and a central hole 34 diameter of substantially four-hundredths of an inch for the passage of the axially directed electron beam 14. Fabrication of a slow wave structure 50 of these dimensions requires manufacturing techniques which depart greatly from the standard techniques for fabricating slow wave structures known to those skilled in the art of manufacturing traveling wave tubes.

The process of manufacturing the slow wave structure 50 of this invention begins with a solid bar of copper of slightly larger diameter and length than the corresponding dimensions of the slow wave structure, a little larger than one-quarter of an inch and one inch, respectively, for the exemplary structure. The length of the bar is greater than the length of the finished slow wave structure 50 to facilitate machining of the bar. The first step in the fabrication process is to reduce the diameter of the bar to the precise diameter (within the allowed tolerance, in our case, 0.2450 max./0.2446 min. inches) of the slow wave structure 50 by conventional lathe machining techniques. Machining the rod to a cylindrical form establishes its central axis 15.

Figure 3:
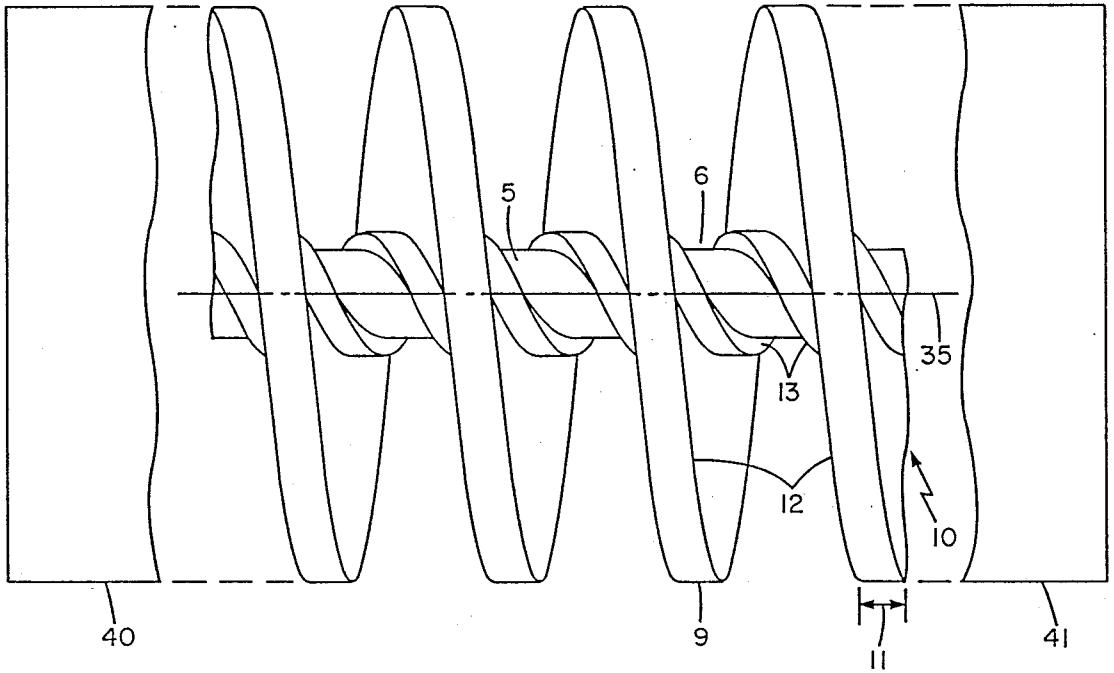
FIG. 3 is a side view of the slow wave structure of FIG. 1 prior to completion of its fabrication.

The rod is secured at both its ends 40, 41 while being delicately machined on a lathe to form the screwthread-like structure 10 shown in broken side view in FIG. 3. The delicateness of the machining required to fabricate the structure 10 is made evident by the following typical dimensions where the width dimension 11 of the screwthreads is 0.0202 inches max./0.0198 inches min. The screwthreads 12 terminate on a ridge 13 whose diameter is 0.0532 inches max./0.0528 inches min. A groove 6 is machined to be centrally located between the screwthreads 12 and have a diameter 0.039 inches max./0.037 inches min. and a width of 0.0322 inches max./0.0318 inches min. typically. The screwthread-like structure 10 extends at a minimum over the length of the desired finished slow wave structure which, in this example, is 1.002 inches max./0.998 inches min.

The next step in the fabrication of the slow wave structure is to form, by conventional lathe machining techniques, a cylindrical sleeve of copper 38 having an outer diameter of 0.344 inches max./0.343 inches min. and inner diameter of 0.2455 inches max./0.2452 inches min. The inner and outer diameters of the sleeve 38 are concentric with respect to one another within 0.001 inches. The length of the sleeve 38 is 1.001 inches max./0.999 inches min. The sleeve 38 is slid over the slow wave structure 10 of FIG. 3 after which the sleeve 38 is brazed to the periphery of the screwthreads 12. Sleeve 38 provides structural support for the screwthread structure 10 thereby allowing the ends 40, 41 to be removed by machining to cause the screwthread structure 10 to be contained within the sleeve 38.

Figure 4:
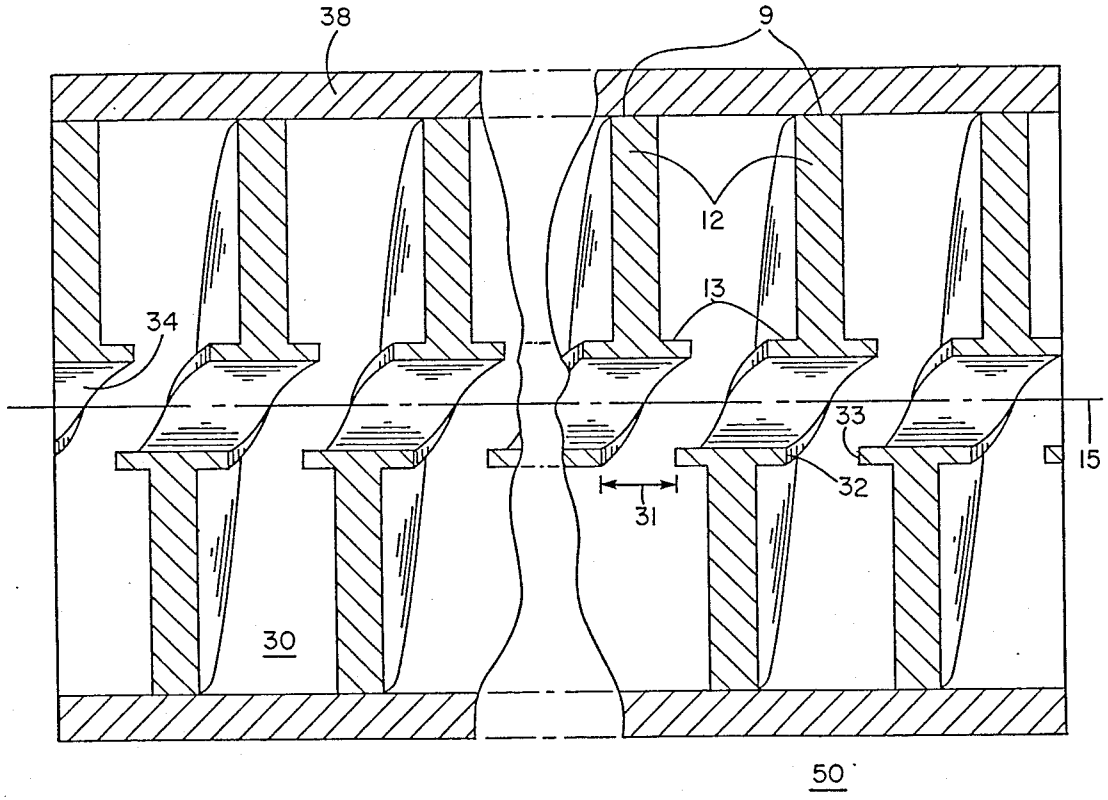
FIG. 4 is a longitudinal cross-sectional view of the completed slow wave structure of this invention.

The next step in the fabrication of the finished slow wave structure 50 of FIG. 4 is to remove the core 5 of the slow wave structure 10 leaving the ridges 13 and their associated screwthreads 12 as shown in FIG. 4. The material to be removed has a diameter 0.039 inches max./0.037 inches min. which corresponds to the diameter of the central core 5 forming the base of the groove 6. The core 5 is removed by using an electric discharge machine which uses a pointed electrode centered on the axis 35 to erode the central core 5 of the structure 10 of FIG. 3 so that all the core 5 out to the bottom of groove 14 is removed leaving only the ridge 13 and its associated screwthread 12. A fluid is used to remove the particles that are being eroded by the electrode as the process of electric discharge machining takes place. Control of the electric discharge machining may be maintained by observing the uniformity of the erosion of the material 5 between adjacent edges of the ridges 13. If desired, the material 5 may be removed in one pass of the electrode down the axis 15 of the screw-like structure 10 or the material may be removed in two or more passes of the electrode depending upon the skill of the operator of the electric discharge machine. The slow wave structure 50 with its central core 5 removed and with the sleeve 38 brazed to the periphery 9 of screwthreads 12 is shown in the cross-sectional view of FIG. 4. The structure 50 of FIG. 4 is the slow wave structure of the traveling wave tube 1 of FIG. 1.

Having described a preferred embodiment of the invention, it will be apparent to one of skill in the art that other embodiments incorporating its concept may be used. It is felt, therefore, that this invention should not be limited to the disclosed embodiment but rather should be limited only by the spirit and scope of the appended claims.

What is claimed is:

1. A method for fabricating a helical waveguide slow wave structure comprising:

machining a deep, narrow first groove in a cylindrical bar of electrically conductive material to form a helical screwthread between the bar ends centered about an axis, said screwthread forming the upper and lower helical walls of a helical waveguide structure;

machining a second groove at the bottom of said first groove to form at least one ridge extending transversely to at least one face of said screwthread, said second groove bottoming on a central core extending axially along said screwthread;

brazing an electrically conductive sleeve to the periphery of said screwthread to form an outer wall connecting said screwthread walls of said helical waveguide structure;

machining away said cylindrical bar ends to cause said screwthread walls to terminate at the end of said sleeve; and machining a hole along the axis of said cyindrical bar to remove the central core to produce a helical waveguide having radially-extending helical walls, a cylindrical outer wall, and an inner wall comprising at least one helical axially-extending ridge with an axial gap between the adjacent portion of said ridge.

2. The method of claim 1 wherein said machining of said second groove midway between said screwthread forms two ridges extending axially toward each other from opposing faces of said screwthread.

3. The method of claim 1 wherein:

said machining of said hole comprises electric discharge machining.

4. The method of claim 1 wherein:

said machining of a deep, narrow first groove, said machining of said second groove, and said machining of said cylindrical bar ends is precision lathe machining.

5. The method of claim 1 comprising in addition:

machining on a lathe a piece of bar stock to provide said cylindrical bar having circular symmetry with respect to said axis.

6. The method of claim 1 wherein:

said sleeve is machined on a lathe to have an inner diameter sufficiently larger than the outer diameter of said helical screwthread to allow said sleeve to pass over the periphery of said screwthread to be substantially concentric therewith, and to allow brazing of said screwthread periphery to said sleeve.

7. The method of claim 6 wherein said sleeve and said screwthread are formed from the same type of material.

8. The method of claim 7 wherein said material is copper.

* * * * *